US005655384A

United States Patent [19]

Joslin, Jr.

[11] Patent Number: 5,655,384

[45] Date of Patent: Aug. 12, 1997

[54] SELF-COOLING CONTAINER INCLUDING LINER MEMBER

[75] Inventor: William Daniel Joslin, Jr., Boynton Beach, Fla.

[73] Assignee: The Joseph Company, Laguna Niguel, Calif.

[21] Appl. No.: 448,737

[22] Filed: May 24, 1995

[51] Int. Cl.[6] ..... F25D 3/10

[52] U.S. Cl. ..... 62/294; 62/457.3; 62/4; 126/263.04

[58] Field of Search ..... 62/293, 294, 457.3, 62/119, 4, 371; 165/104.26, 104.31, 911; 126/263.01, 263.04

[56] References Cited

U.S. PATENT DOCUMENTS

| | | | |
|---|---|---|---|
| 2,460,765 | 2/1949 | Palaith . | |
| 3,074,243 | 1/1963 | Tilden . | |
| 3,144,754 | 8/1964 | Tilden . | |
| 3,309,890 | 3/1967 | Barnett et al. . | |
| 3,373,581 | 3/1968 | Strader . | |
| 3,494,141 | 2/1970 | Irwin et al. . | |
| 3,494,142 | 2/1970 | Beck . | |
| 3,525,236 | 8/1970 | Solhkhah . | |
| 3,636,726 | 1/1972 | Rosenfeld et al. . | |
| 3,654,768 | 4/1972 | Inglis et al. . | |
| 3,726,106 | 4/1973 | Jaeger . | |
| 3,786,643 | 1/1974 | Anderson et al. . | |
| 3,919,856 | 11/1975 | Beck . | |
| 4,584,848 | 4/1986 | Barnett . | |
| 4,640,102 | 2/1987 | Tenenbaum et al. . | |
| 4,656,838 | 4/1987 | Shen . | |
| 4,669,273 | 6/1987 | Fischer et al. | 62/294 |
| 4,679,407 | 7/1987 | Kim et al. . | |
| 4,688,395 | 8/1987 | Holcomb . | |
| 4,736,599 | 4/1988 | Siegel . | |
| 4,784,678 | 11/1988 | Rudick et al. . | |
| 4,941,328 | 7/1990 | Sheu . | |
| 5,010,736 | 4/1991 | York et al. . | |
| 5,131,239 | 7/1992 | Wilson . | |
| 5,201,183 | 4/1993 | Ramos . | |
| 5,214,933 | 6/1993 | Aitchison et al. . | |
| 5,285,812 | 2/1994 | Morales . | |
| 5,325,680 | 7/1994 | Baroso-Lujan et al. . | |
| 5,331,817 | 7/1994 | Anthony | 62/293 |
| 5,394,703 | 3/1995 | Anthony . | |

*Primary Examiner*—John M. Sollecito

*Attorney, Agent, or Firm*—Robbins, Berliner & Carson, LLP

[57] ABSTRACT

A self-cooling container incorporating a heat exchange unit including a chamber for containing a quantity of a gas, the chamber including an external wall in contact with the beverage to be cooled, actuator means for actuating the heat exchange unit, a liner member disposed concentric and inside the wall of the chamber for facilitating flow of the gas throughout the heat exchange unit, and a means for exhausting the gas from the chamber. The actuator means includes a valve for controlling the release of the gas from the chamber having a valve stem which when reciprocated axially will open and close the valve to allow gas to discharge through the stem. The actuator means also includes a sealer having a plurality of tabs spaced around its outer periphery for preventing the heat exchange unit from coming out of the container. A support member is affixed to the base of the chamber for locking the heat exchange unit in position after it is inserted in the container. The support member includes a first and second ring connected together by a plurality of arms, wherein the first ring is affixed to the chamber and the second ring is constructed to fit within the countersink of the container.

24 Claims, 9 Drawing Sheets

FIG. 3a
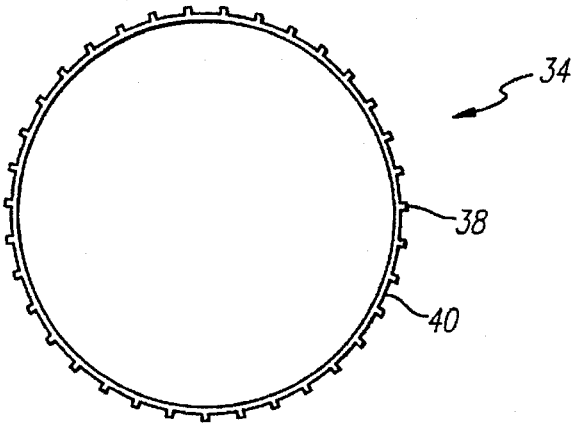
FIG. 3b
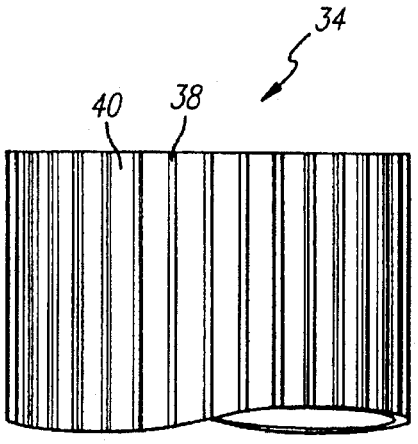
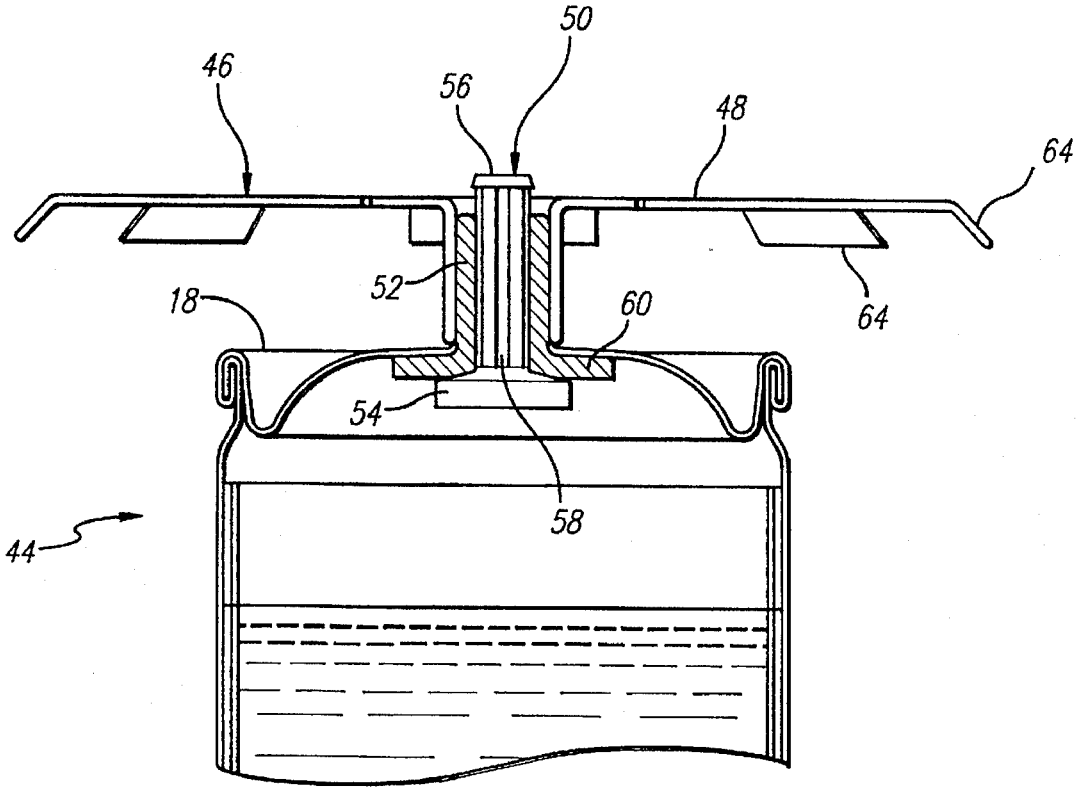
FIG. 4

FIG. 5
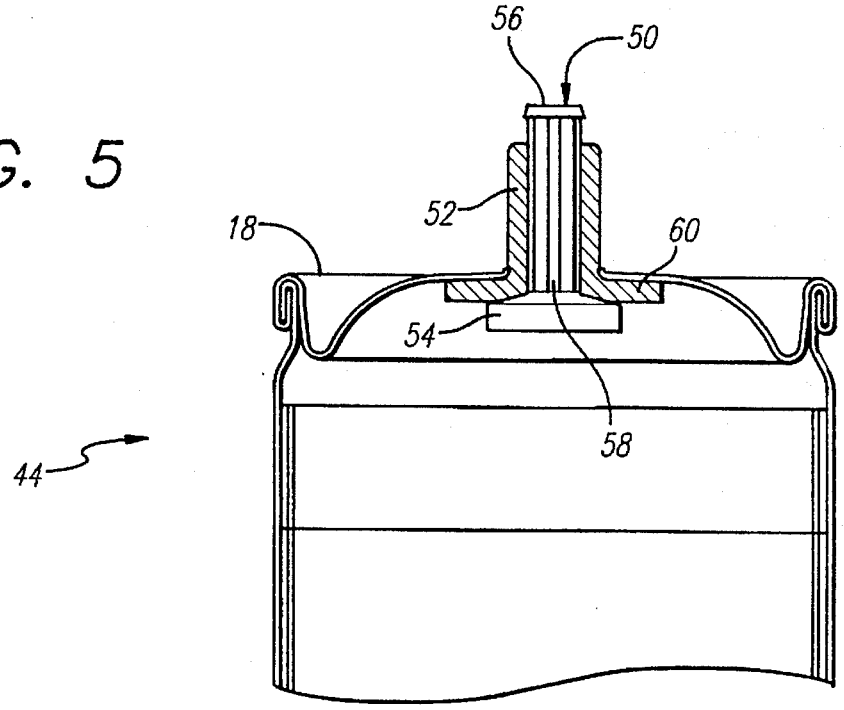
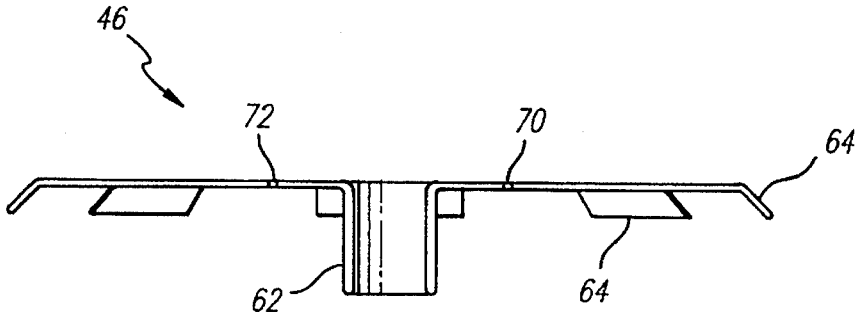
FIG. 6a
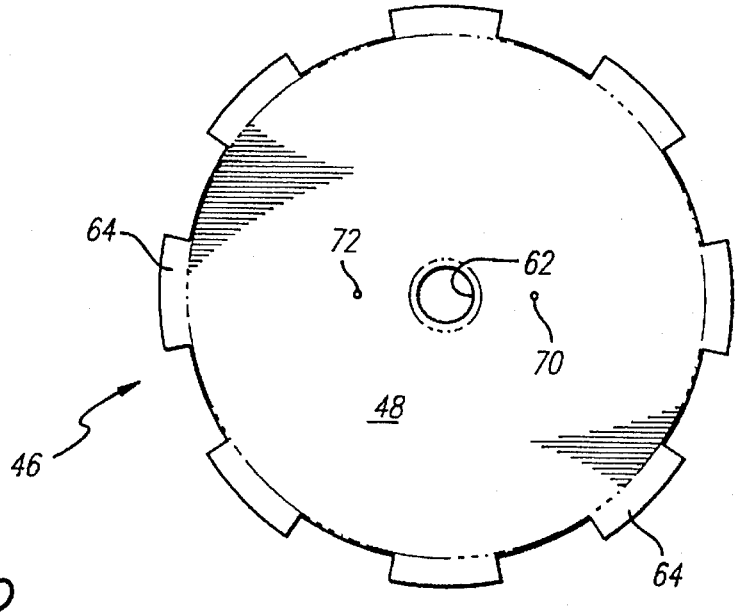
FIG. 6b

SELF-COOLING CONTAINER INCLUDING LINER MEMBER

BACKGROUND OF THE INVENTION

1. Field of the Invention

The present invention relates generally to temperature changing devices, and more specifically to self-cooling containers for cooling a product, such as a beverage.

2. Description of the Prior Art

It has long been desirable to provide a simple, effective and safe device which may be housed within a container, such as a beverage container, for the purpose of cooling a product, such as a beverage, on demand. Such self-cooling devices, even if effective, normally will cool the product with all of the attendant disadvantages thereof such as environmental hazard, bulkiness, expense and the like. Various types of devices have been developed to accomplish the desired self-cooling such as devices which rely on chemical endothermic and exothermic reactions, devices which require pneumatic circuits, devices using desiccant absorbing agents and water, and devices which rely on well-known electrical effects for both heating and cooling. Typical self-cooling devices known to Applicant for chilling beverages and the like are exemplified by U.S. Pat. Nos. 2,460,765; 3,373,581; 3,636,726; 3,726,106; 4,584,848; 4,656,838; 4,784,678; 5,214,933; 5,285,812; 5,325,680; and 5,331,817.

Self-cooling devices utilized in the prior art exemplified by the above-identified patents have generally been unsatisfactory. Some of the difficulties which have been encountered are that the devices (1) generally rely on toxic and environmentally unfriendly chemicals, (2) require very bulky pneumatic circuits and cannot economically be used in small containers such as beverage cans or foods cans, (3) are rather complex and are thus expensive to manufacture and maintain, and (4) are ineffective.

What is needed therefore is a device which may be inserted in a container for self-cooling which is simple, effective and safe.

SUMMARY OF THE INVENTION

The preceding and other shortcomings of prior art products are addressed and overcome by the present invention which provides a self-cooling container incorporating a heat exchange unit including a chamber for containing a quantity of a gas, the chamber including an external wall in contact with the beverage to be cooled, actuator means for actuating the heat exchange unit, a liner member disposed concentric and inside the wall of the chamber for facilitating flow of the gas throughout the heat exchange unit, and a means for exhausting the gas from the chamber. The actuator means includes a valve for controlling the release of the gas from the chamber having a valve stem which when reciprocated axially will open and close the valve to allow gas to discharge through the stem. The actuator means also includes a sealer having a plurality of tabs spaced around its outer periphery for preventing the heat exchange unit from coming out of the container. A support member is affixed to the base of the chamber for locking the heat exchange unit in position after it is inserted in the container. The support member includes a first and second ring connected together by a plurality of arms, wherein the first ring is affixed to the chamber and the second ring is constructed to fit within the countersink of the container.

The foregoing and additional features and advantages of this invention will become apparent from the detailed description and accompanying drawing figures that follow. In the figures and the written description, numerals indicate the various features of the invention, like numerals referring to like features throughout for both the drawing figures and the written description.

BRIEF DESCRIPTION OF THE DRAWINGS

FIG. 3(*a*) is a top view of the liner member of the heat exchange unit;

FIG. 3(*b*) is a side view of the liner member as illustrated in FIG. 3(*a*);

FIG. 4 is a cross-sectional view of the actuator subassembly of the heat exchange unit;

FIG. 5 is a cross-sectional view of the actuator subassembly of the heat exchange unit without the sealer plate;

FIG. 6(*a*) is a cross-sectional view of the sealer plate including diaphragm of the actuator subassembly;

FIG. 6(*b*) is a top view of the sealer plate including diaphragm illustrated in FIG. 6(*a*);

DETAILED DESCRIPTION OF THE PREFERRED EMBODIMENTS

Figure 1:
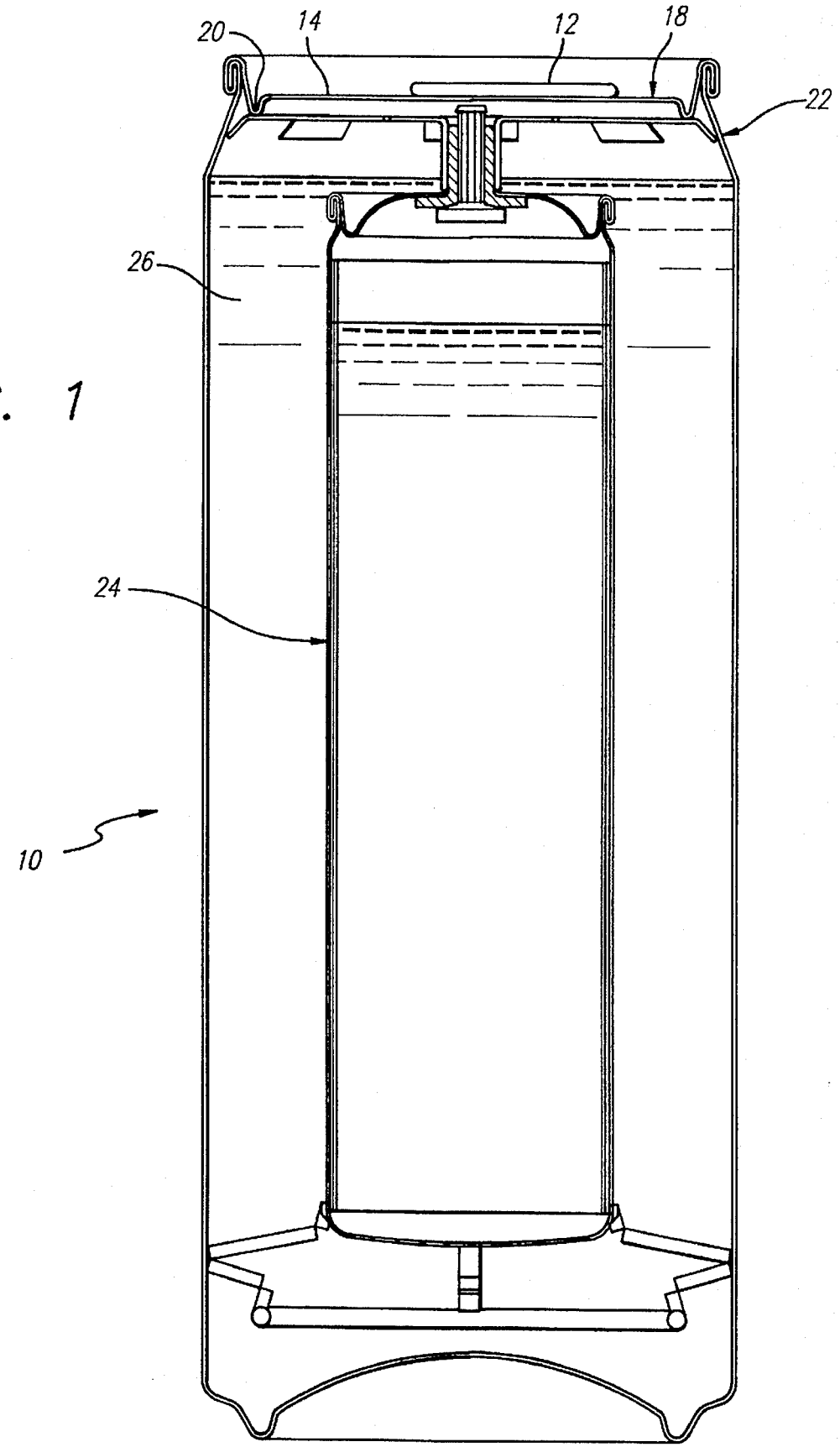
FIG. 1 is a cross-sectional view of a self-cooling beverage container incorporating a heat exchange unit in a deactivated condition in accordance with the present invention.

Referring to FIG. 1, there is shown generally a self-cooling container 10 for holding a product, such as beer, soft drinks, fruit drinks and the like, constructed in accordance with the principles of the present invention. For illustrative purposes, the present invention is illustrated and described herein using a conventional beverage container. The present invention may be implemented in both conventional and specially designed beverage containers. The present invention is not limited, however, to providing self-cooling for beverage-type containers. Rather, the present invention may be used to provide self-cooling for a variety of different applications, including but not limited to cooling beverage, food, chemical and industrial containers of various sizes and shapes, as well as conventional refrigeration systems.

As is well known in the art, the container 10 includes a lid 18 which includes a conventional pull tab 12 secured to a panel 14 such that when the pull tab 12 is lifted, the panel 14 is bent into the container 10. The operation of the tab 12 in bending the tear panel 14 into the container 10 is well known in the art. The lid 18 conventionally includes an annular ridge 20 which is crimped to the top end 22 of the container 10.

As is shown in FIG. 1, the container 10 includes a heat exchange unit (HEU) 24, suspended in the beverage 26, for facilitating cooling of the beverage 26 as will be explained further herein. By referring now more particularly to FIG. 2, a more detailed illustration of the HEU 24 is provided. As is therein shown, the HEU 24 includes a chamber 28, actuator subassembly 44 and support member 74. The chamber 28 contains a gas 30 which is employed to cool the beverage 26 and is contained under pressure in a compressed or liquified state. A variety of gases may be used, including, but not limited to, isobutane, propane, carbon dioxide, CFC's, HCFC's, and the like. The preferred gas 30 employed to cool the beverage 26 is HFC 152A (difluoroethane). The gas 30 is stored at a pressure of 85 p.s.i.a. at 75 degrees F. A mixture which can be used is a mixture of butane and HFC 134A (tetrafluoroethane) in a ratio of 60:40 (butane:HFC 134A). Alternatively, the chamber 28 may contain a compressed gas 30 such as air, carbon dioxide, an air/$CO_2$ mixture or the like. One skilled in the art will appreciate that the mixture of the gases will vary depending on various factors, including but not limited to the degree of cooling that is desired, the nature of the gas 30, the pressure in the HEU 24, and the size of the container 10 with which the HEU 24 is used.

Figure 2:
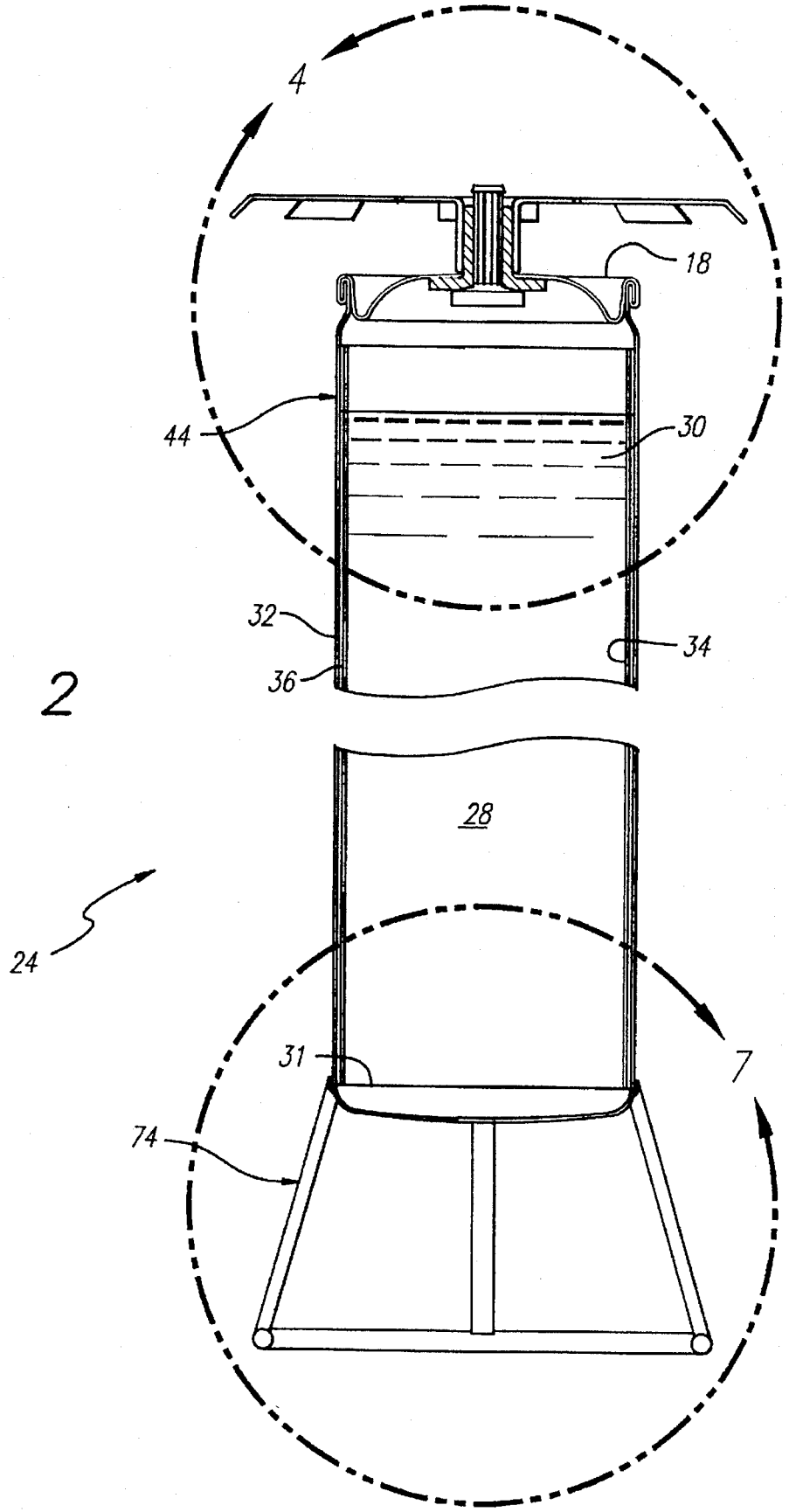
FIG. 2 is a cross-sectional view of the heat exchange unit.

As illustrated in FIG. 2, the chamber 28 includes a base 31, a lid 18 and a wall 32. The HEU 24 absorbs heat from the beverage 26 through the HEU wall 32 which is preferably cylindrical in shape and manufactured from a heat conducting material such as aluminum. Alternatively, the HEU Wall 32 may be manufactured from a plastic material, including but not limited to polycarbonate, polyethylene and polyester and the like.

Referring now more specifically to FIGS. 3(*a*) and 3(*b*), the liner member 34 is illustrated in further detail. As will further be noted and hereinafter more fully described, the liner member 34 increases the effective heat transfer surface, thereby isolating the evaporation process and reducing the time for the gas to evaporate. As a result of this process, the time required for the heat transfer process is decreased, thereby allowing for more effective cooling.

As is therein shown, the liner member 34, concentric with the HEU wall 32, surrounds the inner surface 36 of the HEU wall 32 and facilitates the flow of gas 30 throughout the HEU 24. The liner member 34 is preferably manufactured from a material, such as polypropylene, which can be wetted by the gas 30 to increase the flow of gas 30 between the liner member 34 and the interior surface of the HEU wall 32. Other plastics, including, but not limited to, polyester (PET) and the like may be used as well.

As is shown in FIGS. 3(*a*) and 3(*b*), the liner member 34 includes a plurality of ribs 38 spaced along the outer surface 40 of the liner member 34 to form channels 42 running from the top to the bottom of the HEU 24. In the preferred embodiment, the ribs 38 are disposed vertically, that is, perpendicular to the base 30 of the chamber 28. It will be understood by those skilled in the art that the ribs 38 may be disposed in alternative configurations to provide for effective cooling of the beverage 26. The plurality of ribs 38 form a plurality of channels 42 along the inner surface 36 of the HEU wall 32.

Typically, each rib 38 extends from the liner member 34 approximately 0.02 inch (0.51 mm) and is approximately 0.02 inch (0.51 mm) in width, and the liner member 34 is approximately 2.23 inches (56.6 mm) in height and has a length sufficient to engage the entire inside surface 36 of the chamber 28. Typically, the ribs 38 are spaced 10 degrees apart and a liner member 34 contains 36 ribs. Those skilled in the art will readily recognize that the dimensions of the ribs 38 and channels 42 will vary depending on factors, including but not limited to the size of the HEU 24 in which the liner member 34 is used and the dimensions of the container 10 the HEU 24 is designed to cool.

Referring to FIGS. 1 through 3(*b*), in operation, once the HEU 24 has been activated, the pressure on the gas 30 in the chamber 28 decreases which causes the liquified gas 30 to flow into the bottom of the chamber 28. The initial heat transfer between the beverage 26 and the liquified gas 30 occurs within the plurality of channels 42. Heat from the beverage 26 is absorbed by the gas 30 through the HEU wall 32 as the gas 30 vaporizes by means of adiabatic expansion. As the temperature of the gas 30 increases, the liquified gas 30 begins to boil causing bubbles which are pumped upward into the channels 42. This boiling action thus propels the liquified gas 30 upward into the channels 42 and causes virtually the entire interior surface area of the HEU wall 32 to be bathed with liquified gas, even as the gas level drops down to small amounts. For example, even when the level of gas drops to a quarter of an inch, liquified gas will continue to be pumped up and bathe virtually the entire interior surface area of the HEU wall 32. Further exposure of the upward flowing gas 30 to the heat exchange surface of the chamber 28 causes the gas 30 to boil off. This progressive boiling and propagation of the liquified gas 30 insures that the entire interior surface of the HEU wall 32 and the base 30 of the chamber 28 is bathed with liquified gas 30. The liner member 34 thus increases the effective heat transfer surface, thereby isolating the evaporation process and reducing the time for the gas to evaporate. As a result of this process, the time required for the heat transfer process is decreased, thereby allowing for more effective cooling.

In accordance with an advantage of the present invention, when a mixture of gases is desired, the present invention does not require the gases to azeotrope because of the local agitation that occurs. In other words, as a result of the bubbling which occurs and the isolation of the evaporation process, a mixture of gases will still evaporate and maintain their initial percentages throughout the evaporation process without having to be azeotropic.

As is shown more in detail in FIG. 4, the HEU 24 further includes an actuator subassembly 44 for actuating the HEU 24. The actuator subassembly 44 includes a valve 54 having a valve stem 50, sealer 46, diaphragm 48 and base 52. The valve 54 may be any commercially available valve 54 having a valve stem 50 which when reciprocated axially will open and close the valve 54 to allow the gas to discharge through the stem 50. As is shown in detail in FIG. 5, the valve stem 50 is substantially tubular in construction and preferably has a fluted stem. The valve stem 50 protrudes axially through the lid 18 of the HEU 24 on one end 56 and cooperates with the valve 54 on the other end 58. The valve stem 50 is captured in part by a base 52 which is similarly substantially tubular in construction. The base 52 engages a portion of the valve stem 50 and expands radially into a flange 60. The valve stem 50 and the valve 54 are preferably manufactured from polyester (PET), although other types of plastic, including but not limited to polypropylene, polyethylene and nylon and the like may be used.

More specifically, the sealer 46 as illustrated in FIG. 4 is shown in greater detail in FIGS. 6(*a*) and 6(*b*). As is shown in FIG. 6(*a*), the sealer 46 is substantially flat and circular and includes a shaft 62 disposed about its center for capturing the valve stem 50 and the base 52 shown in FIG. 5 in a snap fit. As is shown in FIG. 6(*b*), the sealer 46 includes a plurality of tabs 64 spaced around its outer periphery. The tabs 64 are preferably bent in a downward descending direction and are used to secure the sealer 46 to the inner wall 66 of the container 10. When the sealer 46 is secured to the valve stem 50 and the base 52, the tabs 64 on the sealer 46 engage the inner wall 66 of the container 10, thus preventing the HEU 24 from coming out of the container 10. In the preferred embodiment, eight tabs 64 are disposed evenly about the circumference of the sealer 46. Typically, each tab extends from the sealer 46 approximately 0.2 inches and is approximately 0.2 inches in width. One skilled in the art will appreciate that the number of as well as the dimensions of the tabs 64 will vary depending on various factors, including but not limited to the size of the HEU 24 in which the liner member 34 is used and the dimensions of the container 10 the HEU 24 is designed to cool.

Typically, in a canning process for carbonated and non-carbonated beverages, before the container 10 is sealed, a shot of an inert gas 30 such as nitrogen is injected into the container 10 to pressurize the container 10. The HEU 24 is constructed such that when the container 10 is filled with beverage 26, the HEU 24 floats toward the top of the container 10 and is prevented by the tabs 64 disposed about the sealer 46 from protruding from the container 10. In the sealed container 10, the pressure of the beverage 26 slowly increases due to a release of nitrogen pressure and/or carbonation within the body of the beverage 26. The HEU 24, guided by the shape of the container 10 and more particularly the countersink 80 on the container 10, floats upwardly and the tabs 64 on the sealer 46 engage the countersink 80 on the container 10.

As is shown in detail in FIG. 6(*b*), the sealer 46 includes a diaphragm 48 which is substantially flat and circular and includes an aperture 68 for the valve stem 50 to extend through. The diaphragm 48 is preferably manufactured from a material, such as polyester (PET), which has an elastic property such that the diaphragm 48 can be compressed or deformed when the HEU 24 is activated, as discussed in detail below. Other materials such as polypropylene and the like may be used as well. A portion of the valve stem 50 protrudes axially through the base 52 and the shaft 62 in the sealer 46.

As shown in FIG. 6(*b*), the diaphragm 48 also includes apertures 70, 72 positioned therein. Typically, the apertures 70, 72 are disposed approximately 0.25 inches from the outside diameter of the diaphragm along opposing ends. As previously noted, in a typical canning process for carbonated and non-carbonated beverages, before the container is sealed, a shot of inert gas such as nitrogen is injected into the container to pressurize the container. The apertures 70, 72 allow the nitrogen gas or carbonation to escape so that the HEU 24 is not activated as it attaches to the lid 18 of the container 10. The apertures 70, 72 are dimensioned such that they will allow the pressure in the container to slowly equilibrate during the filling process and after activation has occurred.

Figure 7:
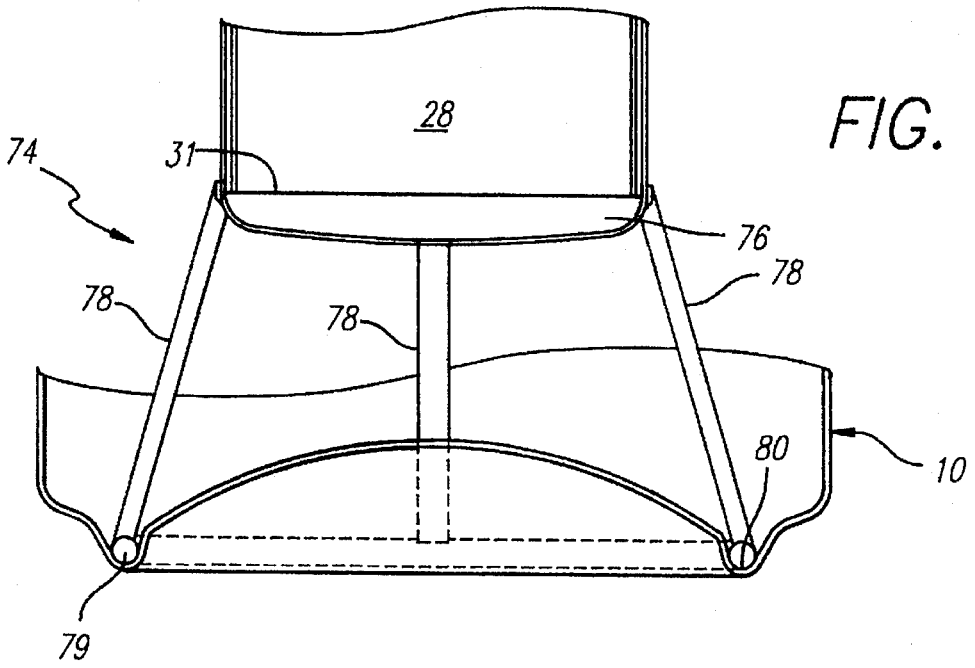
FIG. 7 is a cross-sectional view of the support assembly of the heat exchange unit.

Referring now more specifically to FIG. 7, the support member 74 is illustrated in detail. As is therein shown, the support member 74 is affixed to the base 30 of the chamber 28 for locking the HEU 24 in position after it is inserted into the container 10. As will be further noted and hereinafter more fully described, the support member 74 utilized to lock the HEU 24 in position is constructed by molded rings 76 and 78 connected together by a plurality of arms 78. In particular, the support member 74 includes a first ring 76 affixed to the chamber 28 of the HEU 24 and a second ring 78 constructed to fit into the countersink 80 of the container 10. The first and second rings 74, 76 are connected to each other by a plurality of arms 78. In the preferred embodiment, four arms 78 are disposed evenly about the circumference of the rings 74, 76. One skilled in the art will appreciate that the dimensions of the support member 74, including the number of arms 78 will vary depending on various factors, including but not limited to the size of the HEU 24 in which the liner member 34 is used and the dimensions of the container 10 the HEU 24 is designed to cool.

The support member 74 may be manufactured from a wide range of materials and assume any of a variety of designs provided the support means maintains the HEU 24 with respect to the panel 14 such that the HEU 24 is not activated until the panel 14 is opened and when the panel 14 is opened, the panel 14 acts on the HEU 24 as described below. The support member 74 is preferably manufactured from a plastic material, such as PET, which has elastic or spring-like properties such that the support member 74 could be compressed or deformed and the HEU 24 could be inserted into the container 10 whereafter it springs open and holds the HEU 24 in position therein.

Figure 8:
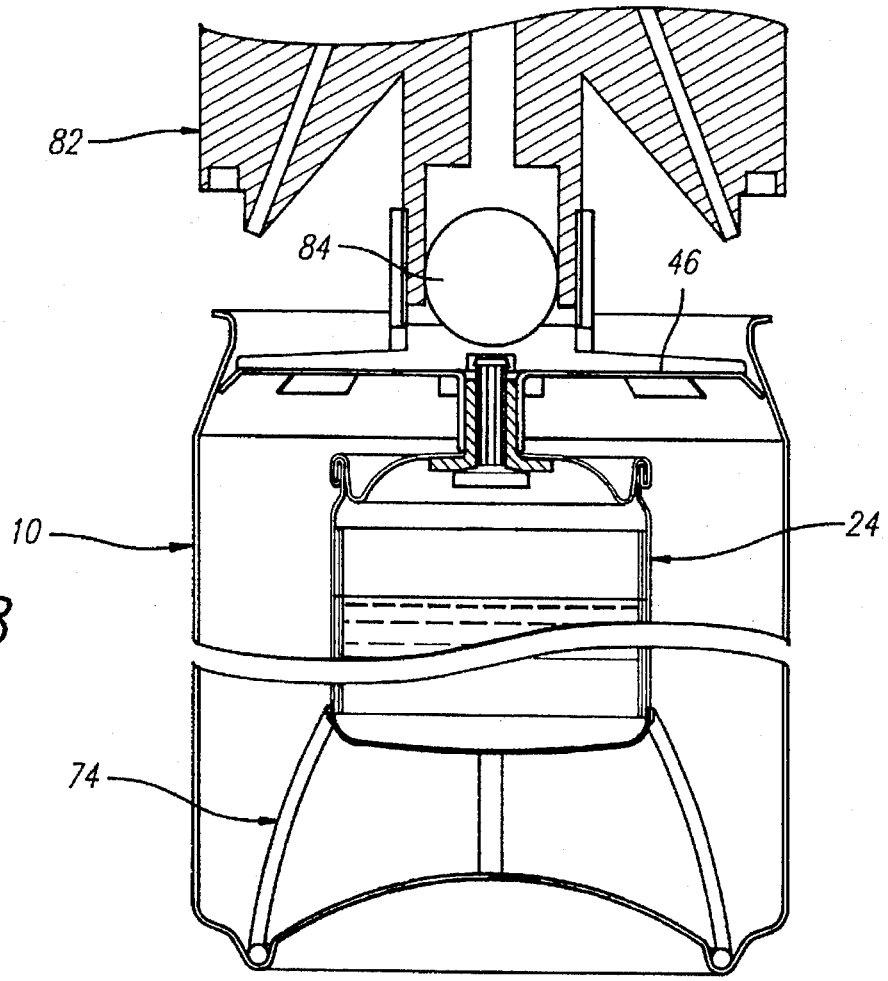
FIG. 8 is a cross-sectional view of a filler valve assembly for use with the heat exchange unit.
Figure 9:
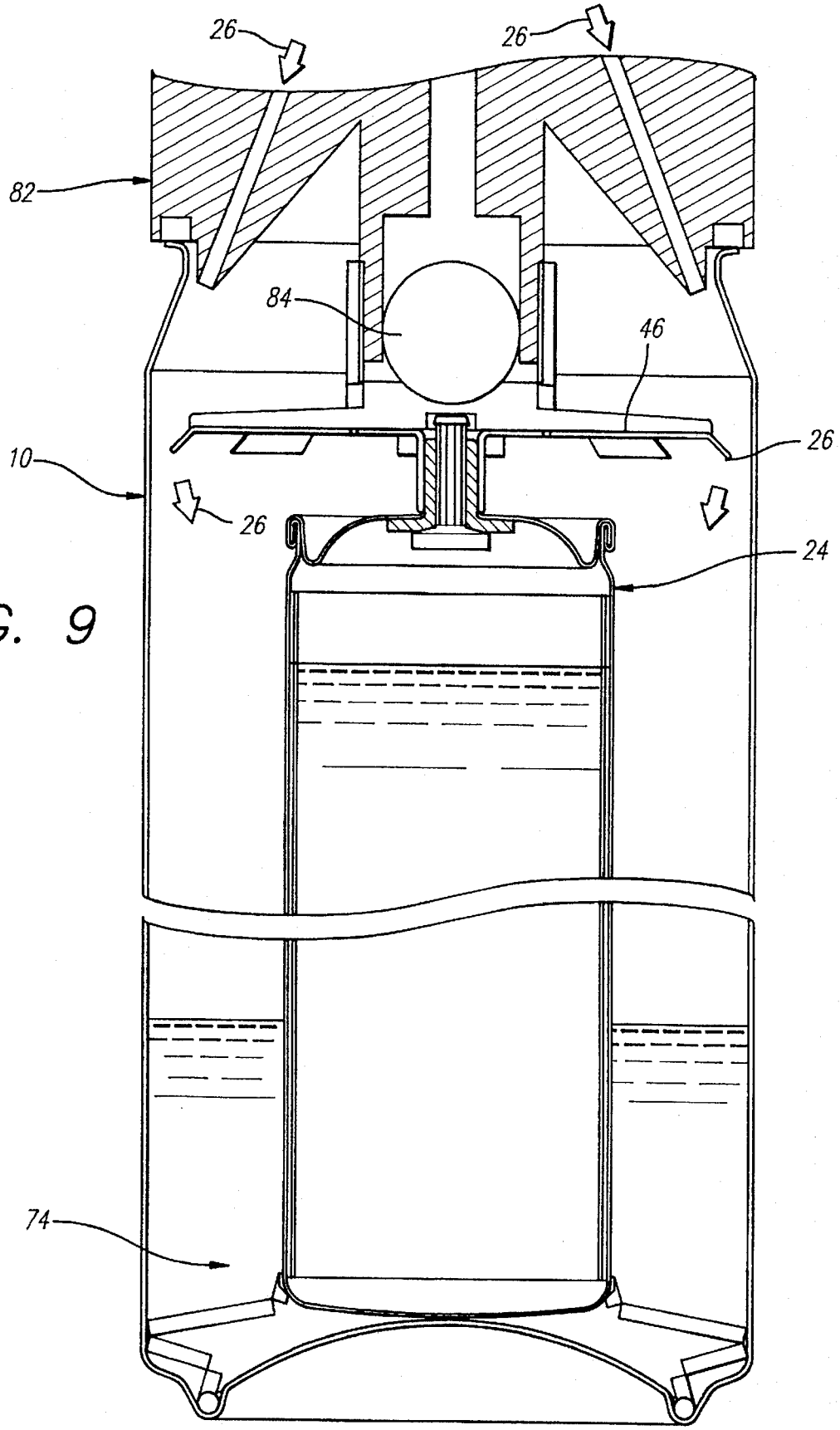
FIG. 9 is a cross-sectional view of the filler valve assembly illustrated in FIG. 8 injecting beverage into the self-cooling beverage container incorporating the heat exchange unit.
Figure 10:
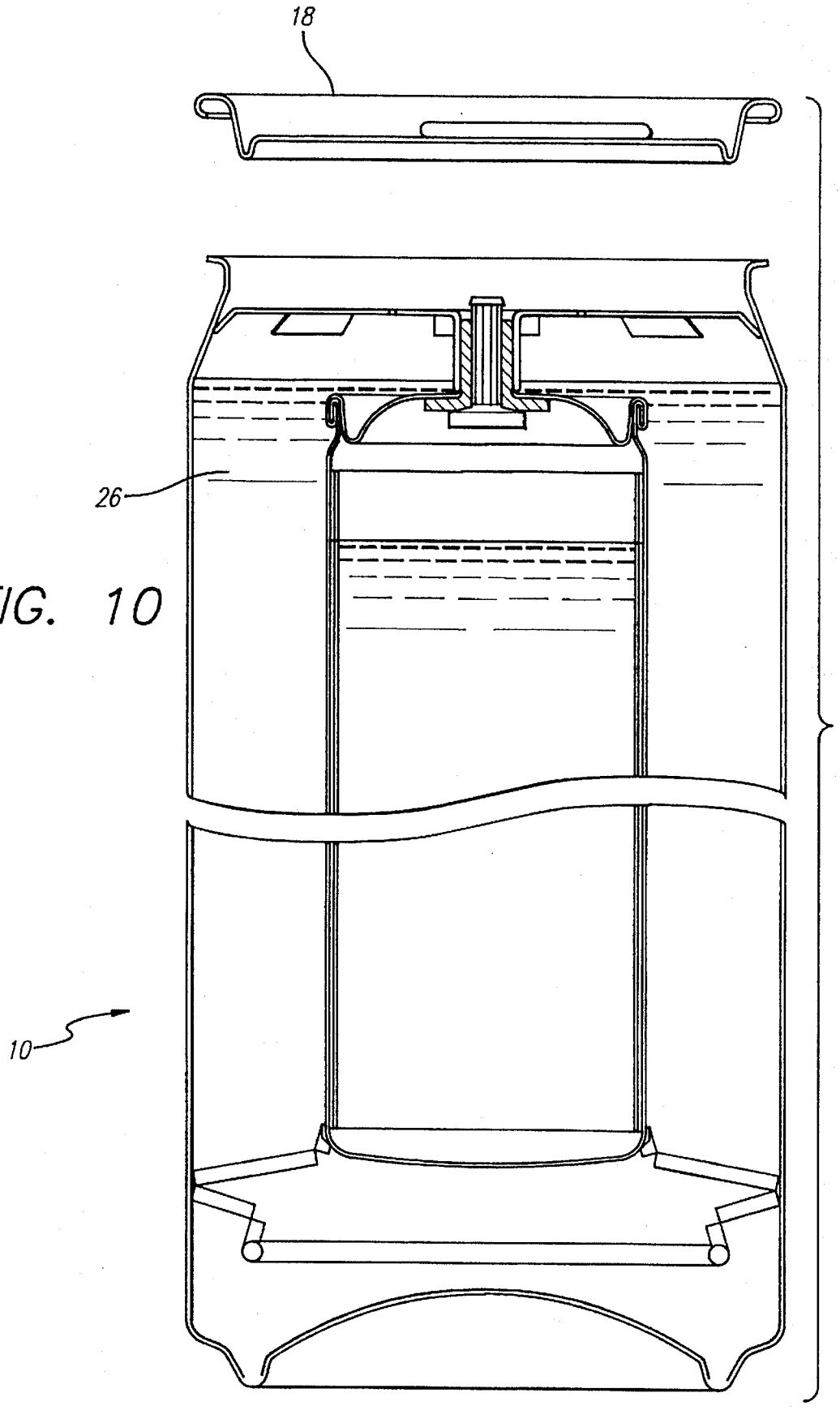
FIG. 10 is a cross-sectional view of the self-cooling beverage container incorporating the heat exchange unit before the container is sealed.

Referring now more specifically to FIGS. 8 and 9, a filler valve assembly 82 for filling the container 10 with beverage 26 is shown. In operation, after the HEU 24 has been inserted into the container 10, the container 10 is injected with beverage 26, the lid 18 (not shown) is positioned on the container 10 and seamed into position. As is shown in FIG. 8, the filler valve assembly 82 includes an adapter 84 preferably manufactured from plastic, such as polyester (PET) for mating with the sealer 46 on the HEU 24. As the filler valve assembly 82 descends towards the container 10 during the canning process, the adapter 84 mates with the sealer 46 and the arms 78 on the support member 74 start to bow and collapse as shown in FIG. 9. The beverage 26 can then be injected from the filler valve assembly 82 into the container 10. As is illustrated in FIG. 10, once the container 10 has been filled with beverage 26, the filler valve assembly 82 is removed and the lid 18 is positioned on the container 10 and seamed into position.

It should be appreciated that the present invention is not limited to using the filler valve assembly 82 for filling the container 10 with beverage as described herein. Rather, with minor modifications, standard commercial filling mechanisms may be used as well.

Figure 11:
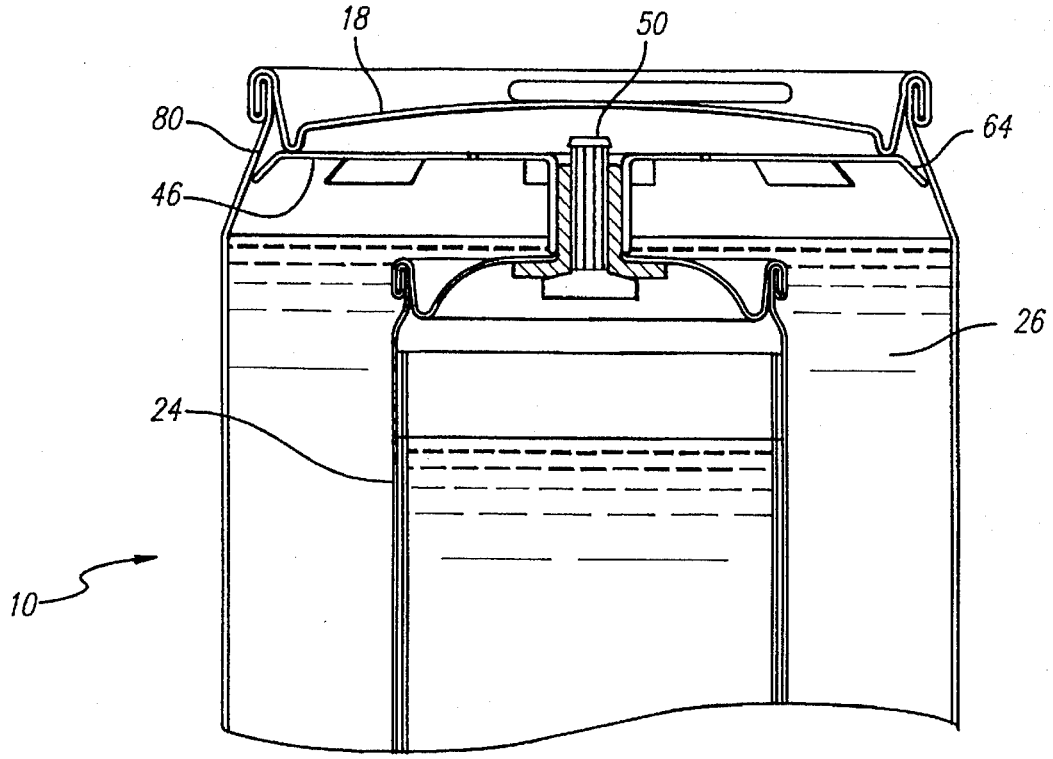
FIG. 11 is a cross-sectional view of the self-cooling beverage container incorporating the heat exchange unit prior to activation.

Referring now more particularly to FIG. 11, the container 10 incorporating the HEU 24 prior to activation is illustrated. The HEU 24 is constructed such that when the container 10 is filled with beverage 26, the HEU 24 floats toward the top of the container 10 and is prevented by the tabs 64 disposed about the sealer 46 from protruding from the container 10. In the sealed container 10, the pressure of the beverage 26 slowly increases due to a release of nitrogen pressure and/or carbonation within the body of the beverage 26. As is shown in FIG. 11, a dome is formed in the lid 12 of the container 10 due to the pressure build up. The clearance between the lid 12 and the top of the valve stem 50 is increased at this point. The HEU 24, guided by the shape of the container 10 and more particularly the countersink 80 on the container 10, floats upwardly and flat surface of the sealer 46 engages the countersink 80 on the container 10. As previously noted, the apertures 70, 72 (not shown) positioned on the diaphragm 48 (not shown) allow the nitrogen gas or carbonation to escape so that the HEU 24 is not activated as it seals with the lid 18 of the container 10.

Figure 12:
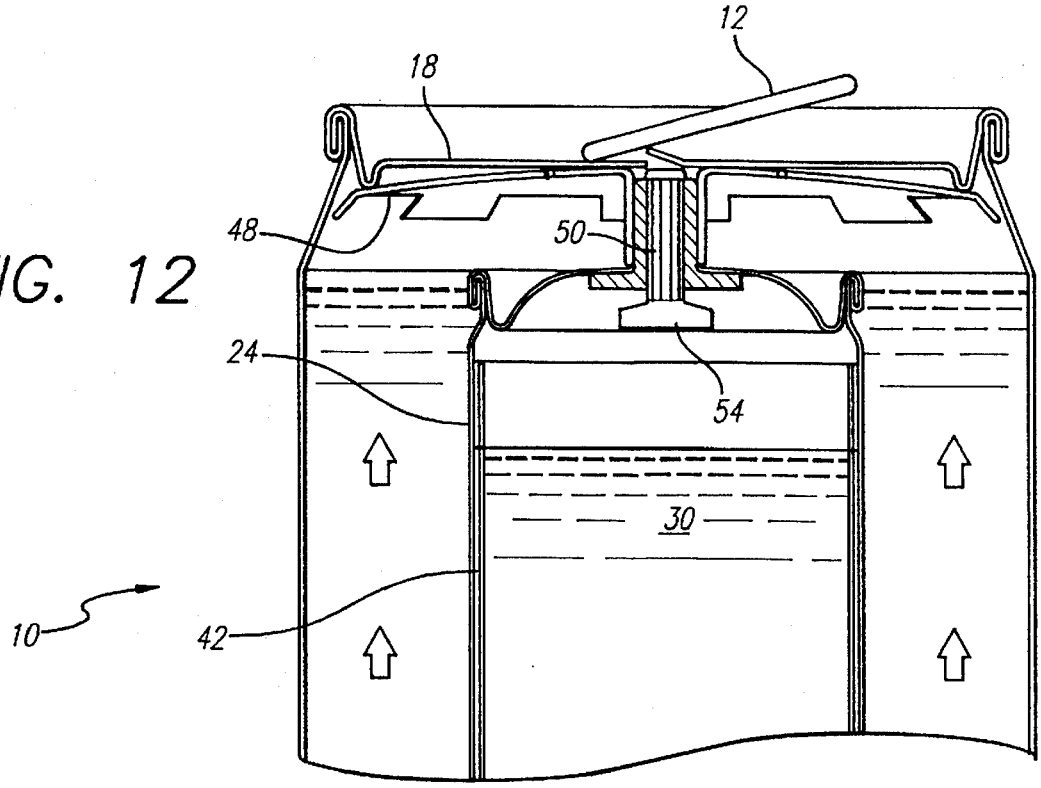
FIG. 12 is a cross-sectional view of the self-cooling beverage container incorporating the heat exchange unit during initial activation.

Referring now more particularly to FIG. 12, the container 10 incorporating the HEU 24 during initial activation is illustrated. To activate the HEU 24, the container 10 is opened by means of the pull tab 12 in the lid 18. Upon opening the container 10, a pressure differential is created between the space above the diaphragm 48, which attains atmospheric pressure, and the pressure below the diaphragm. The pressure differential between the pressure which is trapped below the diaphragm 48 and the atmospheric pressure in the space above the diaphragm 48 forces the HEU 24 towards the lid 18 of the container 10, causing the valve stem 50 to be depressed when it contacts the lid 18 and preventing the pull tab 12 from being opened all the way. This pressure differential results from the pressure below the diaphragm being approximately 45 p.s.i.a. at room temperature and the atmospheric pressure being approximately 15 p.s.i.a. As is shown in FIG. 12, the upward motion of the HEU 24 causes the diaphragm 48 to flex upwardly. The valve stem 50 is pushed toward the valve 54 by contact with the lid 18 of the container 10. As the valve stem 50 moves towards the valve 54, the passage is opened as the shoulder of the valve stem 50 moves away from the shoulder of the base 52. Once the passage is opened, the gas 30 that is formed rises to the top, flows from the top of the channels 42 formed by the liner member 34 into the space vacated by the liquified gas 30 in the chamber 28, vents out through the valve stem 50, and then flows through the lid 18 of the container 10 by means of the opening created by the pull tab 12.

Once the HEU 24 has been activated, the pressure on the gas 30 in the chamber 28 decreases which causes the liquified gas 30 to flow into the bottom of the chamber 28. Heat transfer between the beverage 26 and the liquified gas 30 occurs within the channels 42 as previously described.

Figure 13:
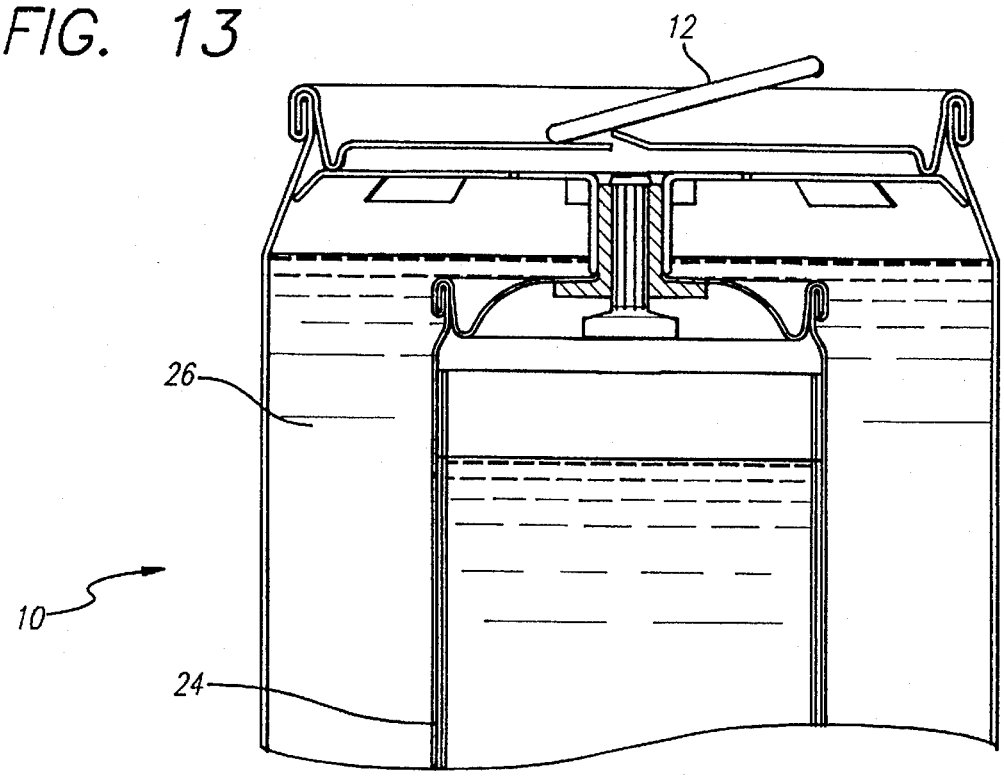
FIG. 13 is a cross-sectional view of the self-cooling beverage container incorporating the heat exchange unit following initial activation.

Referring now more particularly to FIG. 13, the container 10 incorporating the HEU 24 after the gas is gone is illustrated. As previously described, after the gas 30 has flowed up and through the channels 42, it is exhausted from the container 10.

Figure 14:
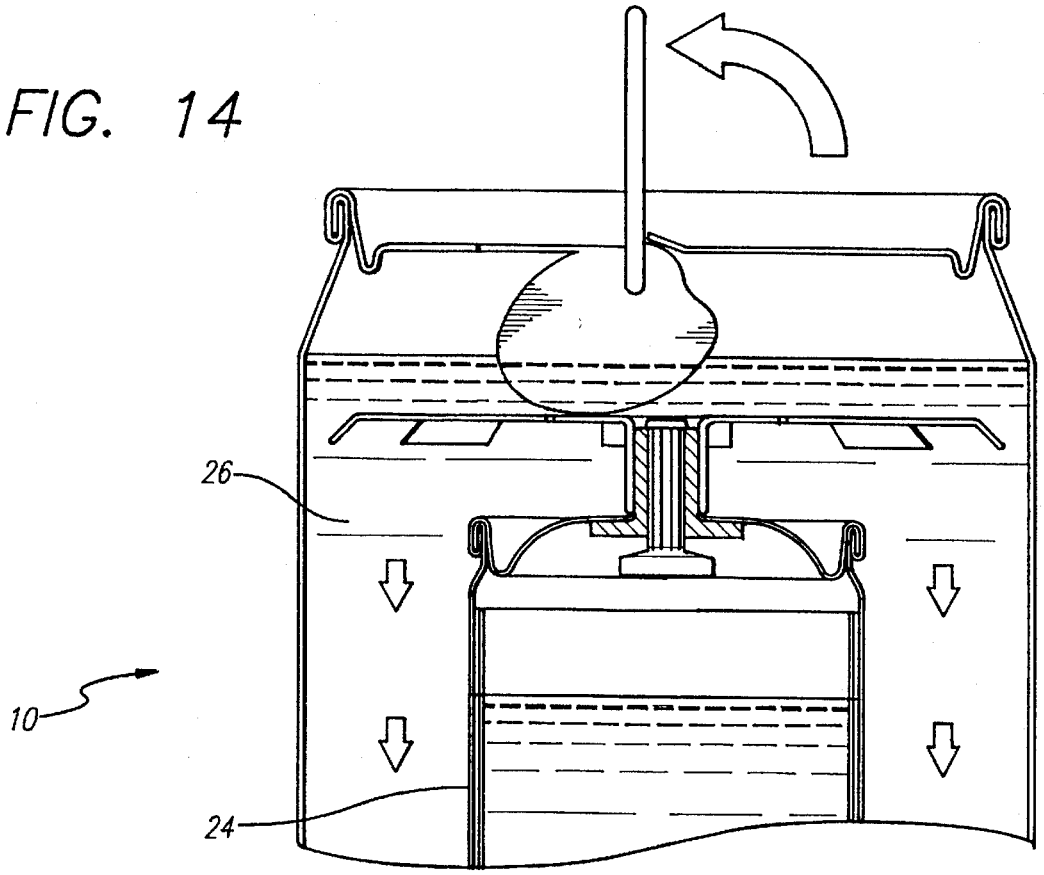
FIG. 14 is a cross-sectional view of the self-cooling beverage container incorporating the heat exchange unit after activation is completed.

During the cycle of evaporation, the pressure of the area below the diaphragm will normalize to atmospheric pressure. As the pressure of the beverage 26 decreases, the pressure differential between the area above and below the diaphragm 48 correspondingly decreases. Eventually, the pressures will equalize and the diaphragm 48 will no longer maintain its flexed position. The HEU 24 will then be pushed away from the lid 18 by the recoiling of the diaphragm 48 to its original, flat condition. As is shown in FIG. 14, the pull tab 12 can now be moved the rest of the way, causing the HEU 24 to be pushed down and away from the lid 18 and the product can be poured or consumed directly from the container 10.

It will be appreciated by persons skilled in the art that the present invention is not limited to what has been shown and described hereinabove, nor the dimensions of sizes of the physical implementation described immediately above. The scope of invention is limited solely by the claims which follow.

What is claimed is:

1. A heat exchange unit for cooling a medium, comprising:

a chamber for containing a quantity of a gas, said chamber including a wall in contact with said medium to be cooled;

actuator means for actuating said heat exchange unit;

a panel disposed concentric and adjacent said wall of said chamber for increasing the effective heat transfer surface of said wall, wherein said panel comprises a plurality of ribs spaced along a surface of said panel to form a plurality of channels; and a means for exhausting said gas from said chamber.

2. The heat exchange unit claimed in claim 1, wherein said actuator means further comprises:

a valve for controlling the release of said gas from said chamber, wherein said valve further includes a valve stem which when reciprocated axially will open and close said valve to allow said gas to discharge through said stem.

3. The heat exchange unit claimed in claim 2, wherein said actuator means further comprises:

a sealer including a shaft disposed about its center for capturing said valve stem.

4. The heat exchange unit claimed in claim 3, wherein said sealer includes a plurality of tabs spaced around its outer periphery for securing said sealer to the inner wall of a container enclosing said heat exchange unit, wherein said tabs minimize movement of said heat exchange unit within said container.

5. The heat exchange unit claimed in claim 4, wherein said tabs are disposed in a substantially downward descending direction.

6. The heat exchange unit claimed in claim 5, wherein said sealer further includes a diaphragm having a substantially flat and circular surface and an aperture for said valve stem to extend through.

7. The heat exchange unit claimed in claim 6, wherein said diaphragm further includes a plurality of apertures defined therein for allowing said gas to escape so that said heat exchange unit is not activated as it attaches to a lid of said container.

8. The heat exchange unit claimed in claim 1, wherein said plurality of ribs are disposed generally vertically along said panel to form said plurality of channels running from the top to bottom of said heat exchange unit.

9. The heat exchange unit claimed in claim 8, wherein said panel is formed from a material which can be wetted by said gas to increase the flow of said gas between said panel and said wall.

10. The heat exchange unit claimed in claim 9, wherein said gas is liquified gas and said panel is formed from polypropylene.

11. A self-cooling container for holding a medium to be cooled, comprising:

a heat exchange unit for cooling said medium comprising:

a chamber for containing a quantity of a gas, said chamber including a wall in contact with said medium to be cooled;

actuator means for actuating said heat exchange unit;

a panel disposed concentric and inside said wall of said chamber for increasing the effective heat transfer surface of said wall, wherein said panel comprises a plurality of partitions disposed along a surface of said panel to form a plurality of channels; and a means for exhausting said gas from said chamber.

12. The container claimed in claim 11, wherein said actuator means further comprises:

a valve for controlling the release of said gas from said chamber, wherein said valve further includes a valve stem which when reciprocated axially will open and close said valve to allow said gas to discharge through said stem.

13. The container claimed in claim 12, wherein said actuator means further comprises:

a sealer including a shaft disposed about its center for capturing said valve stem.

14. The container claimed in claim 13, wherein said sealer includes a plurality of tabs spaced around its outer periphery for securing said sealer to an inner wall of said container enclosing said heat exchange unit, wherein said tabs minimize movement of said heat exchange unit within said container.

15. The container claimed in claim 14, wherein said tabs are disposed in a substantially downward descending direction.

16. The container claimed in claim 15, wherein said sealer further includes a diaphragm having a substantially flat and circular surface and an aperture for said valve stem to extend through.

17. The container claimed in claim 16, wherein said diaphragm further includes a plurality of apertures defined therein for allowing said gas to escape so that said heat exchange unit is not activated as it attaches to a lid of said container.

18. The container claimed in claim 17, further comprising:

a support member affixed to the base of the chamber for locking said heat exchange unit in position after it is inserted in said container.

19. The container claimed in claim 18, wherein said support member comprises:

a first and second ring connected together by a plurality of arms, wherein said first ring is affixed to said chamber and said second ring is constructed to fit within said countersink of said container.

20. The container claimed in claim 11, wherein said plurality of partitions are disposed generally vertically along said panel to form said plurality of channels running from the top to bottom of said heat exchange unit.

21. The container claimed in claim 20, wherein said panel is formed from a material which can be wetted by said gas to increase the flow of said gas between said panel and said wall.

22. The container claimed in claim 21, wherein said gas is liquified gas and said panel is formed from polypropylene.

23. A self-cooling container including a product, comprising:

a heat exchange unit for cooling said product comprising:

a chamber for containing a quantity of a gas, said chamber including a partition separating said gas and said product;

actuator means for actuating said heat exchange unit;

a liner disposed concentric and adjacent said partition of said chamber for isolating evaporation of said gas, wherein said liner comprises a plurality of ribs disposed along a surface of said liner to form a plurality of channels so that liquified gas propagates upwards into said channels; and exhaust means for expelling said gas from said chamber.

24. The container claimed in claim 23, wherein said plurality of ribs are disposed generally parallel and vertically along said liner to form said plurality of channels running from the top to bottom of said heat exchange unit.

* * * * *